United States Patent [19]

Hermanns

[11] 4,067,511

[45] Jan. 10, 1978

[54] EXPANSIBLE MANDREL FOR MOUNTING SPOOLS AND THE LIKE IN WINDING MACHINES

[75] Inventor: Peter Hermanns, Stommeln, Germany

[73] Assignee: FMN Schuster & Co., Hurth-Efferen, Germany

[21] Appl. No.: 728,893

[22] Filed: Oct. 4, 1976

[51] Int. Cl.[2] ..... B65H 75/18

[52] U.S. Cl. ..... 242/72.1

[58] Field of Search ..... 242/72 R, 72.1; 279/2

[56] References Cited

U.S. PATENT DOCUMENTS

| | | | |
|---|---|---|---|
| 1,281,861 | 10/1918 | Sibley | 242/72.1 |
| 2,909,338 | 10/1959 | Cozzo | 242/72.1 X |

FOREIGN PATENT DOCUMENTS

| | | | |
|---|---|---|---|
| 304,203 | 11/1929 | United Kingdom | 242/72.1 |

OTHER PUBLICATIONS

Technical Digest No. 14, Apr. 1969, "Quick Acting Expandable Arbor".

*Primary Examiner*—Edward J. McCarthy
*Attorney, Agent, or Firm*—Lowe, King, Price & Markva

[57] ABSTRACT

An expansible mandrel is useful for mounting spools and the like in winding machines. The mandrel comprises asecuring elements for locating clamping segments on the periphery of the mandrel. Mutually opposed conical surfaces are movably disposed with respect to each other for causing the clamping elements to exert an outwardly directed radial pressure thereby holding a mounted spool thereon. Each clamping segment is elongated and has a longitudinal axis disposed parallel to the longitudinal axis of the mandrel. A plurality of recesses are distributed symmetrically with respect to the longitudinal center of each segment. The recesses are bores in a specific embodiment of the invention. The clamping segments are also substantially constant in width along the entire length thereof.

16 Claims, 3 Drawing Figures

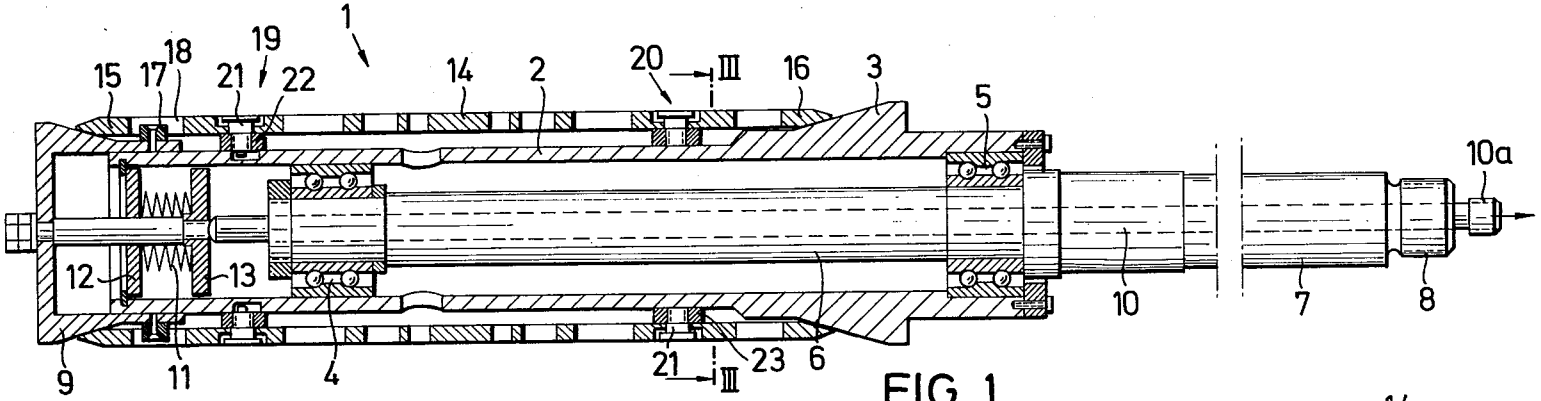
FIG. 1
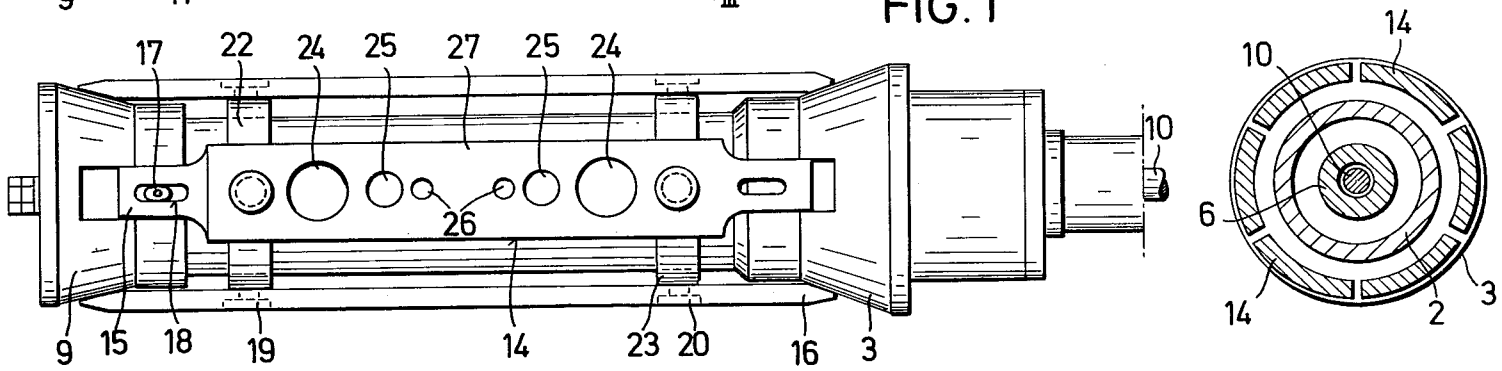
FIG. 2
FIG. 3

EXPANSIBLE MANDREL FOR MOUNTING SPOOLS AND THE LIKE IN WINDING MACHINES

BACKGROUND OF THE INVENTION

The invention relates to a particular structural configuration of an expansible mandrel for carrying spools and the like in winding machines. The spool serves as a carrier for the thread package to be formed on the winding machine.

Many varied constructions of expansible mandrels are known. The mandrels have an outer cover, subdivided by slots alternately opening in opposed directions. Thus, the cover surface may be radially inclined to clamp the spool pushed over the cover. that is, the cover surface exerts a radial pressure along the inside surface of the spool to hold it in place. The spool is mounted on the slotted cover generally by means of one or tow cones designed to run counter to one another. That is, there are two mutually opposed conical surfaces that are axially movable with respect to one another on the mandrel. This causes the cover surface to be spread radially so that the mounted spool is clamped and held secure by the spreading pressure.

Winding machines are operating at constantly increasing thread speeds. Thus, it is necessary to operate the expansible mandrel and spool at high rotary speeds. These rotary speeds may reach from 10,000 to 20,000 rpm. The high rotary speeds generate considerable centrifugal force which acts on the blade-like portions of the mandrel cover. The centrifugal forces cause bending stresses on the blades of the mandrel. Consequently, there is an involuntary raising of the blades above the spreading condition particularly when the spool has been weakened by damage. The spool may even tear as a result of this stress which can occur at the beginning of the winding procedure when an insufficiently strong thread package has been wound onto the spool. Radial bulging or breakage of the blade on the expansible mandrel can also occur. In this case, the cylindrical cover surface on the expansible mandrel is no longer present. Consequently, the winding procedure for forming a thread package is disturbed.

PURPOSE OF THE INVENTION

The primary object of the invention is to provide an expansible mandrel which may operate at high rotary speeds while avoiding the disadvantages of the prior art structures.

A further object of the invention is to provide an expansible mandrel having spreader parts located on its periphery wherein the risk of bulging of the spreader parts is reliably and simply removed even at high rotary speeds of the mandrel.

SUMMARY OF THE INVENTION

These objects and other advantages are accomplished through the use of the expansible mandrel for mounting spools and the like in winding machines as described herein. The mandrel comprises a means for securing clamping elements on the periphery thereof. The operation of cone means causes the clamping elements to exert an outwardly directed radial pressure to hold a mounted spool thereon. Each clamping element comprises an elongated segment having a longitudinal axis disposed parallel to the longitudinal axis of the mandrel. Each segment includes a plurality of recesses distributed symmetrically with respect to the longitudinal center of the segment.

Other features of the invention provide securing rings to which the segments are connected at laterally disposed attachment points. The recesses in each of the segments are located between the attachment points. The cone means includes a pair of mutually opposed conical surfaces that are movable with respect to each other to effect the desired radial pressure.

The design of the mounting clamping segments provides a large carrying surface as a result of using a relatively large width. At the same time, the clamping segments are light weight. As a result of the predetermined arrangement of the recesses, there is a reliable degree of resistance to bending even during extremely high rotary speeds involved during the winding operations. The clamping segment including the distribution of recesses longitudinally therealong cannot bend beyond the acceptable degree of elastic deformation under the effect of the centrifugal forces occurring during the roation of the mandrel. The removal of material to form the recesses provides a lightening of the total weight of the clamping segment. Additionally, the distribution of the recesses in the longitudinal direction of the clamping segments contributes to the desirable bending characteristics noted above.

The recesses at the attachment points require a relatively large width of the clamping segment so that there is enough material available at these points to cross the width thereof. This relatively large width also provides a good and wide support surface for mounting the spool thereon. The size of the distribution of the recesses depends upon the lines of momentum arising from the stress while the mandrel is operating at high rotary speeds. There must be a good resistance value of the cross-section of the clamping segment at the attachment points. There results a specific width for the clamping segment which is retained along the entire length of the segment between the attachment points. The greatest bending moment occurs at the middle of the segment. Therefore, the full cross-section of the wide segment is required at the middle thereof. The recesses are distributed symmetrically with respect to the transverse and longitudinal center of the segments between the central region and the attachment points thereof. In a specific embodiment, the size of the recesses is adapted to the approximate changing values of the momentum curve. The recesses are to be largest near the attachment points in the segment. Accordingly, the recesses situated in the direction of the longitudinal center of the segment decrease gradually or in stages in accordance with the run of the moment line with regard to the width expansion of the recesses. In this way, a lightweight segment having a large peripheral mounting surface and yet being resistant to bending is obtained.

The recesses between the attachment point and the transverse center of the segment may be unified into a single recess. However, an advantageous arrangement consists of separate independent recesses in the form of bores. The bores may be made economically and simply. No complicated and expensive machinery is required. Bores are located at the neutral points of the momentum curve. They decrease in the direction of the transverse center in accordance with the moment stress. The transverse central region of the segment has no recesses, i.e., is a solid component.

BRIEF DESCRIPTION OF DRAWINGS

Other objects of this invention will appear in the following description and appended claims, reference being made to the accompanying drawings forming a part of the specification wherein like reference characters designate corresponding parts in the several views.

FIG. 1 is a longitudinal cross-sectional view of an expansible mandrel made in accordance with this invention;

FIG. 2 is a diagrammatic, fragmentary plan view of the expansible mandrel of FIG. 1; and FIG. 3 is a view taken along line III—III of FIG. 1.

DESCRIPTION OF SPECIFIC EMBODIMENTS

More specifically, referring to the drawings, an expansible mandrel, generally designated 1, has a sleeve 2 rotatably mounted by bearings 4 and 5 on a securing rod 6. Sleeve 2 has a cone at one end thereof. Securing rod 6 is freely supported and fixedly secured by means of a pin portion 7 and a threaded portion 8. An axially movable cone 9 is disposed at the free end of the sleeve 2. Thus, cone 3 and cone 9 provide mutually opposed conical surfaces that are movable with respect to each other. Cone 9 is actuated by a movable rod 10 passing through the securing rod 6. For example, an element (not shown) engages the rod end 10*a* and provides a to and fro movement of the rod 10. A spring arrangement 11 provides a biasing of the cone 9 in the clamping direction, i.e., toward the cone 3. Spring arrangement 11 is supported on a disc 12 which is fixed in sleeve 2. Spring 11 presses against a movable disposed disc 13 connected to cone 9 so that the combination moves together in a direction toward cone 3.

Clamping elements in the form of segments 14 are distributed in an appropriate number on the periphery of the expansible mandrel 1. Segments 14 have beveled ends 15 and 16 as shown in longitudinal cross-section. Ends 15 and 16 engage the mutually opposed conical surfaces of cones 9 and 3, respectively. Slide box 17 engages longitudinal slots 18 to longitudinally guide the segments 14.

Securing rings 22 and 23 surround sleeve 2. Screws 21 connect segment 14 to the laterally displaced attachment points 19 and 20. The segments 14 are attached to rings 22 and 23 which have about 2mm radial play but provide a very close fit in the axial direction of the mandrel. Rings 22 and 23 on the other hand have a radially narrow play on sleeve 2 and are mounted to be axially movable. Thus, segments 14 can be pushed axially with respect to the cones 3 and 9.

Segments 14 include recesses 24, 25 and 26 which are distributed symmetrically to the longitudinal center of segment 14 between the attachment points 19 and 20. In this specific embodiment, recesses 24, 25 and 26 are formed as bores which vary in diameter along the longitudinal length of the elongated segments 14. The steppings or variances in the diammetric dimensions of the bores are affected in accordance with the run of the momentum curve with respect to bending stress. The longitudinal center region 27 of segment 14 has no recesses. Segments 14 are relatively broad as required by the resistance value of the cross-section at attachments 19 and 20. The width remains substantially constant over the length of the effective mounting surface of segment 14. A reduction in weight is achieved by the bores with a corresponding stepping down of their diameter. Consequently, segment 14 has a large carrying peripheral surface and is perfectly resistant to bending at the given rotary speeds and higher. Manufacturing of the segments 14 made in accordance with this invention is extraordinarily favorable.

Alternatively, a large number of bores may be used to effect the desired results instead of the three bores 24, 25 and 26. The number of bores in any situation will depend upon the length of the segments and the specific configuration of the momentum curve. The bores will be correspondingly stepped as required. The segments 14 are suitably composed of lightweight metal alloy.

While the expansible mandrel for mounting spools and the like in winding machines as been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. An expansible mandrel for mounting spools and the like in winding machines, said mandrel comprising:
   a. means for securing clamping elements on the periphery of the mandrel, and
   b. cone means for causing the clamping elements to exert an outwardly directed radial pressure to hold a mounted spool thereon,
   c. each said clamping element comprisng an elongated segment having the longitudinal axis disposed parallel to the longitudinal axis of the mandrel and having lines of momentum arising from the stress while the mandrel is operating at high rotary speeds,
   d. each segment including a plurality of recesses distributed symmetrically with respect to the longitudinal center of the segment,
   e. the size of the recesses being adapted to the approximate changing values of the momentum curve defined by said lines of momentum.

2. A mandrel as defined in claim 1 wherein
said securing means includes securing rings to which the segments are connected at laterally disposed attachment points,
said recesses being located between the attachment points.

3. A mandrel as defined in claim 2 wherein
attachment screws connect the segments to the securing rings and have a degree of radial play,
said screws being guided with a close fit in the axial direction of the mandrel,
said securing rings having a degree of play sufficient to effect axial movement of the rings when the radial pressure is exerted.

4. A mandrel as defined in claim 1 wherein
said cone means includes a pair of mutually opposed conical surfaces that are movable with respect to each other to effect said radial pressure.

5. A mandrel as defined in claim 1 wherein
the recesses of the segments are bores.

6. A mandrel as defined in claim 5 wherein
the segments are secured at laterally disposed attachment points,
the width of each segment is substantially constant along the entire length, and
the bores of the segments are greatest in diameter close to the attachment points and reduce in diameter in the direction toward the longitudinal center of each segment.

7. A mandrel as defined in claim 5 wherein
the longitudinal central region of each segment is free of recesses.

8. A mandrel as defined in claim 1 wherein
the longitudinal center of each segment is free of recesses.

9. An expansible mandrel for mounting spools and the like in winding machines, said mandrel comprising:

a. means for securing clamping elements on the periphery of the mandrel, and b. cone means for causing the clamping elements to exert an outwardly directed radial pressure to hold a mounted spool thereon, c. each said clamping element comprising an elongated segment having the longitudinal axis disposed parallel to the longitudinal axis of the mandrel, d. each segment including a plurality of recesses distributed symmetrically with respect to the longitudinally center of the segment.

e. said securing means includes securing rings to which the segments are connected at laterally disposed attachment points.

f. said recesses being located between the attachment points.

10. A mandrel as defined in claim 9 wherein
attachment screws connect the segments to the securing rings and have a degree of radial play,
said screws being guided with a close fit in the axial direction of the mandrel,
said securing rings having a degree of play sufficient to effect axial movement of the rings when the radial pressure is exerted.

11. An expansible mandrel for mounting spools and the like in winding machines, said mandrel comprising:

a. means for securing clamping elements on the periphery of the mandrel and at laterally disposed attachment points, and b. cone means for causing the clamping elements to exert an outwardly directed radial pressure to hold a mounted thereon, c. each said clamping element comprising an elongated segment having the longitudinal axis disposed parallel to the longitudinal axis of the mandrel, d. each segment including a plurality of bores distributed symmetrically with respect to the longitudinal center of the segment, e. said bores beng greatest in their diameter close to the attachment points and reduce in their diameter in the direction toward the longitudinal center of each segment.

12. A mandrel as defined in claim 11 wherein said securing means includes securing rings to which the segments are connected at said laterally disposed attachment points
said bores being located between the attachment points.

13. A mandrel as defined in claim 12 wherein
attachment screws connect the segments to the securing rings and have a degree of radial play,
said screws being guided with a close fit in the axial direction of the mandrel,
said securing rings having a degree of play sufficient to effect axial movement of the rings when the radial pressure is exerted.

14. A mandrel as defined in claim 11 wherein
said cone means includes a pair of mutually opposed conical surfaces that are movable with respect to each other to effect said radial pressure.

15. A mandrel as defined in claim 11 wherein
the width of each segment is substantially constant along the entire length.

16. A mandrel as defined in claim 11 wherein
the longitudinal central region of each segment is free of recesses.

* * * * *

UNITED STATES PATENT OFFICE

CERTIFICATE OF CORRECTION

PATENT NO. : 4,067,511

DATED : January 10, 1978

INVENTOR(S) : PETER HERMANNS

It is certified that error appears in the above-identified patent and that said Letters Patent are hereby corrected as shown below:

Page 1, insert:

[30] Foreign Application Priority Data

Oct. 2, 1975 Germany ..... 25 43 952.5

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*